US005453917A

United States Patent [19]

Ogawa

[11] Patent Number: 5,453,917

[45] Date of Patent: Sep. 26, 1995

[54] DECORATIVE TUBE WITH NEON TUBE

[75] Inventor: Hiroaki Ogawa, Toyonaka, Japan

[73] Assignee: Kasyu International Corporation, Osaka, Japan

[21] Appl. No.: 932,636

[22] Filed: Aug. 20, 1992

[30] Foreign Application Priority Data

Aug. 22, 1991 [JP] Japan ..... 3-211000

[51] Int. Cl.[6] ..... F21V 23/02

[52] U.S. Cl. ..... 362/222; 362/152; 362/219; 362/220; 362/225; 362/285; 362/368; 362/430; 362/812

[58] Field of Search ..... 362/223, 147, 362/152, 217, 219, 220, 285, 368, 418, 430, 432, 132, 221, 222, 224, 225, 390, 396, 812, 806

[56] References Cited

U.S. PATENT DOCUMENTS

| | | | |
|---|---|---|---|
| 2,295,210 | 9/1942 | Gutensohn | 362/220 |
| 2,800,573 | 7/1957 | Hudson | 362/220 |
| 3,007,037 | 10/1961 | Klemme | 362/220 |
| 3,428,799 | 2/1969 | Bassani | 362/219 |
| 4,161,769 | 7/1979 | Elliott | 362/219 |
| 4,413,311 | 11/1983 | Orenstein | 362/223 |
| 4,712,165 | 12/1987 | Cetrone | 362/147 |
| 4,947,301 | 8/1990 | Steele | 362/374 |
| 4,994,943 | 2/1991 | Aspenwall | 362/217 |
| 5,040,101 | 8/1991 | Aspenwall | 362/418 |

FOREIGN PATENT DOCUMENTS

| | | | |
|---|---|---|---|
| 889612 | 2/1962 | United Kingdom | 362/223 |

*Primary Examiner*—Ira S. Lazarus
*Assistant Examiner*—Alan B. Cariaso
*Attorney, Agent, or Firm*—Koda and Androlia

[57] ABSTRACT

A decorative tube with neon tube to be fixed to an installing base compises a transparent tubular body, a neon tube and a transformer. The neon tube and the transformer are provided within the transparent tubular body, and the transformer is for properly setting the neon tube into a luminous state. A decorative tube is fixed various installing bases, for example installing base made of steel pipe, section steel, wall, or scaffold set up at a construction site. A decorative tube is also made of hard tubular body with an opening on its circumferential wall according to the region wherein the neon tube is disposed. The decorative tube with neon enhances the appearance of construction sites or the like.

16 Claims, 7 Drawing Sheets

DECORATIVE TUBE WITH NEON TUBE

BACKGROUND OF THE INVENTION

1. Field of the Invention

The present invention relates to a decorative tube with neon tube, and more particularly to a decorative tube to be fixed to an installing base such as scaffolds, frames or walls of construction sites and to enhance the aesthetic effect of and around the installing base.

2. Prior Art

Houses and buildings are constructed by setting up plural posts on foundations, linking the posts mutually with horizontal beams to complete the basic structure, and finally finishing the details (minor beams, exteriors, etc) by using of scaffolds built up on the outer circumference of the basic structure.

Although the completed houses and buildings are beautiful, the site in the midst of construction spoils the scenery, and in particular the appearance with exposed scaffolds is ugly.

On the othe hand, such a problem also exists in frames and scaffolds set up at event halls, concert halls, discotheques or the like.

SUMMARY OF THE INVENTION

The decorative tube with neon tube in the present invention comprises a neon tube and a transformer within its hard tubular body, and the transformer is for properly setting the neon tube in a luminous state. The tubular body has an opening on its circumferential wall corresponding to the region where the neon tube is disposed, and an installing member for facilitating the attachment and detachment of the decorative tube to and from its installing base.

The tubular body may be made of transparent material, then no opening is required on its circumferential wall.

The tubular body may be also provided with a connecting member which is capable of easily linking up with another tubular body. In addition, the neon tube may be also supported by an elastic bushing provided within the tubular body.

The installing base may be section steels such as steel tube, walls or scaffolds set up at construction sites.

When the decorative tube or tubes of present invention are fixed to an installing base (such as scaffolds set up at construction sites, frames or scaffolds at event halls, concert halls, discotheques) by means of the installing member, and then the neon tubes are put into a luminous state, the installing bases are illuminated. In other words, the appearance of and around the installing base is enhanced.

Furthermore, by means of the installing member and the connecting member provided on the tubular body, the decorative tube with neon tube may be fixed to the installing base freely and with a variety of positions. And with using a large number of decorative tubes, characters and pictures may be drawn on the large installing base such as large scaffolds built up at construction sites; that is, the large installing base is used as a canvas. The installing member is easily detachable to and from the installing base, and the connecting member is easily detachable to and from the tubular body, and all of them are easily detachable mutually so that assembling and disassembling may be conducted very easily.

Moreover, when the neon tube is supported by the elastic bushing within the tubular body, the impact transmitted to the neon tube from outside through the hard tubular body becomes smaller.

DETAILED DESCRIPTION OF THE INVENTION

Figure 1:
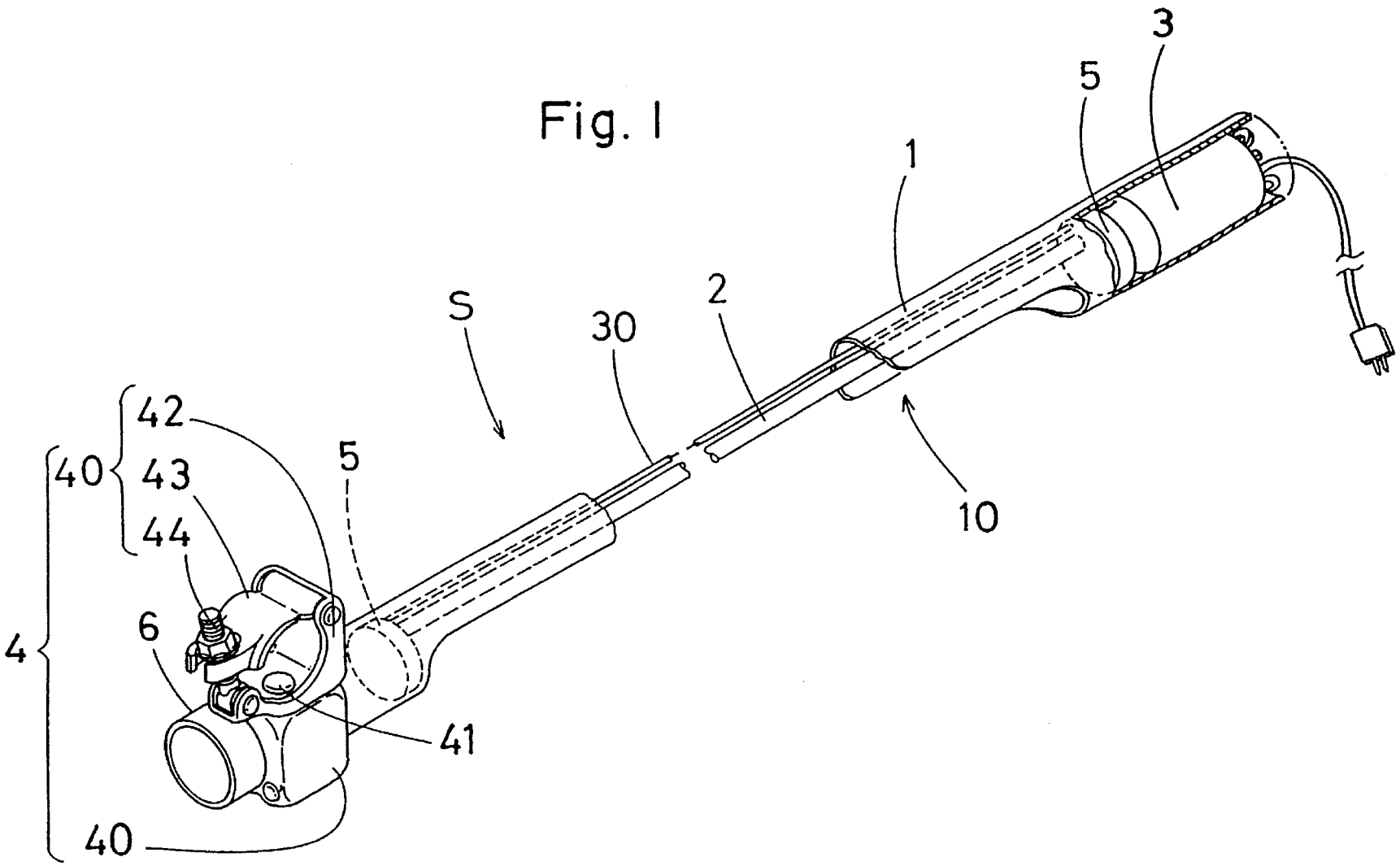
FIG. 1 is a general perspective view of a decorative tube with neon tube in a first embodiment of the present invention.

Referring now to the drawings, the constitution of the present invention is described in detail below by presenting some of the embodiments thereof.

Figure 2:
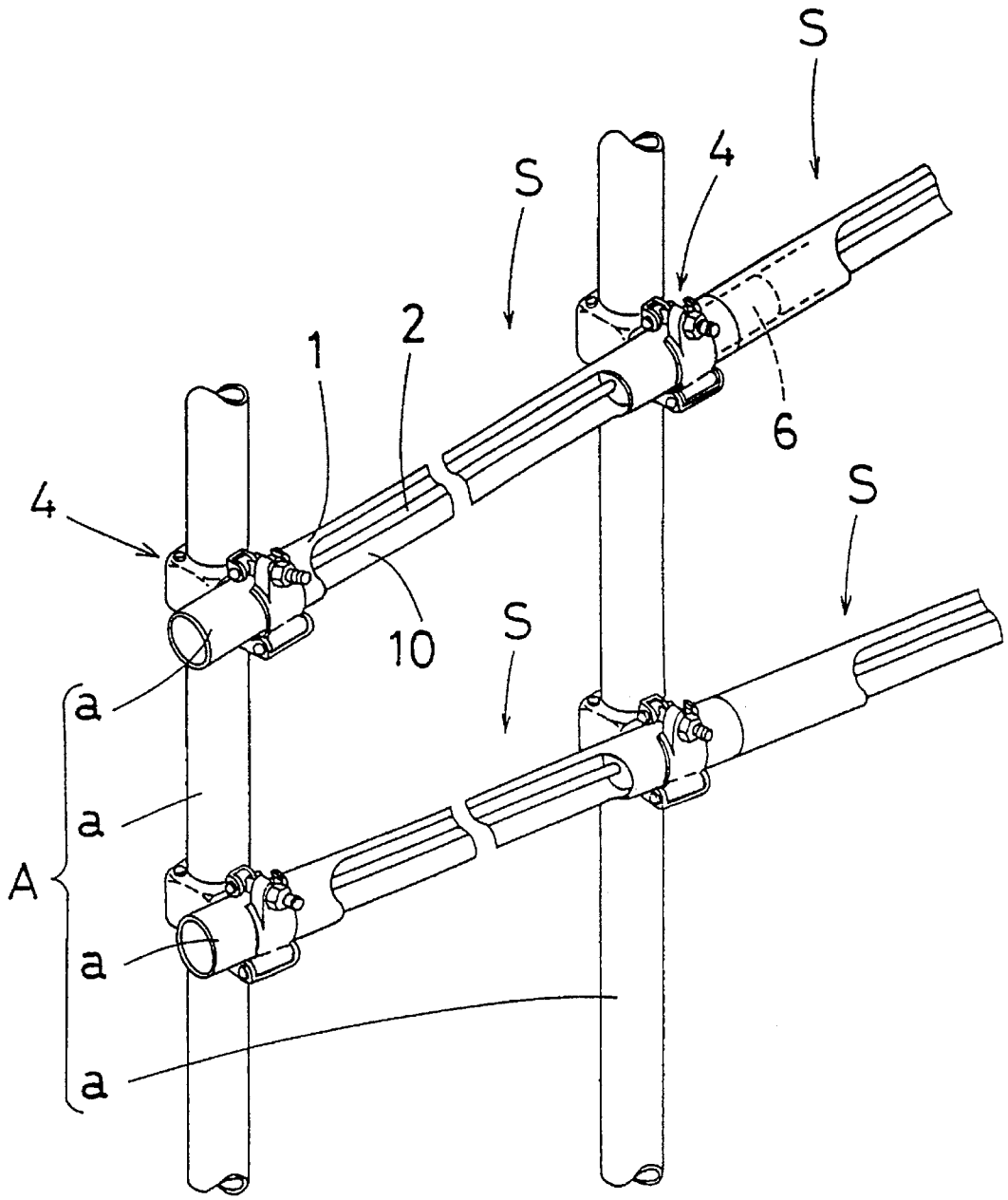
FIG. 2 is a view showing a state where plural decorative tubes of the first embodiment are fixed to steel pipes constructing a scaffold.

As a first embodiment, a decorative tube to be fixed to a scaffold set up at a construction site (hereinafter referred to as decorative tube S) is described below. As shown in FIGS. 1 and 2, a neon tube 2 and a transformer 3 for properly setting the neon tube 2 in a luminous state are disposed within a hard tubular body 1, and an opening 10 is provided on the circumferential wall of the tubular body 1 corresponding to the region where the neon tube 2 is disposed. A clamp member 4 for attaching the decorative tube S to the scaffold is placed at an end (or both ends) of the tubular body 1.

The tubular body 1 is made of steep pipe of about 1.5 m in length (SGP50A, a steel pipe of about 65 mm in outside diameter), and the opening 20 of about 1 m in length and 4 cm in width is formed in its circumferential wall as shown in FIG. 1. In this embodiment, a steel pipe of about 65 mm in outside diameter is employed, but it is not limitative, and steel pipes of various outside diameters may be used.

The neon tube 2 is about 1.2 m in length and 12 mm in diameter, and as shown in FIG. 1 its both ends are stably supported by elastic supporting members 5 (made of urethane rubber) provided within the tubular body 1.

The transformer 3 is designed to avoid dew condensation therein, and formed in columnar shape with the diameter slightly smaller than the inside diameter of the tubular body 1 as shown in FIG. 1. The capacity is 8W, 0.1 A, so that the household power source may be directly used out of a wall outlet. The neon tube 2 and the transformer 3 are properly wired electrically, and the wiring 30 passing through the opening 10 is positioned behind the neon tube 2.

The clamp member 4 is composed of two unit clamps 40 40, as shown in FIG. 1, which are retained by a pin 41 so as to rotate mutually, and each unit clamp 40 comprises, as shown in FIG. 1, a base body 42 with substantially L-shaped section, an oscillating element 43 oscillatably fixed to the base body 42, and bolt and nut 44 for tightening the base body 42 and the oscillating element 43 which is oscillatably fitted to the base body 42. Therefore, adjusting the bolt and nut 44 allows the tubular body 1 itself to be easily detached from the clamp member 4 and the position of the tubular body 1 to be easily altered, and more the tubular body 1 is easily detached from a steel pipe (a) constituting a scaffold (A), as shown in FIG. 2.

In this embodiment, particularly as shown in FIGS. 1 and 2, as a connecting member 6, a columnar piece or a cylindrical piece is projecting from the open end of the tubular body 1, and the projecting portion from the tubular body 1 of this connecting member 6 is inserted into the open part of another tubular body 1 as shown in FIG. 2, thereby the decorative tube being easily connected with another decorative tube.

Figure 3:
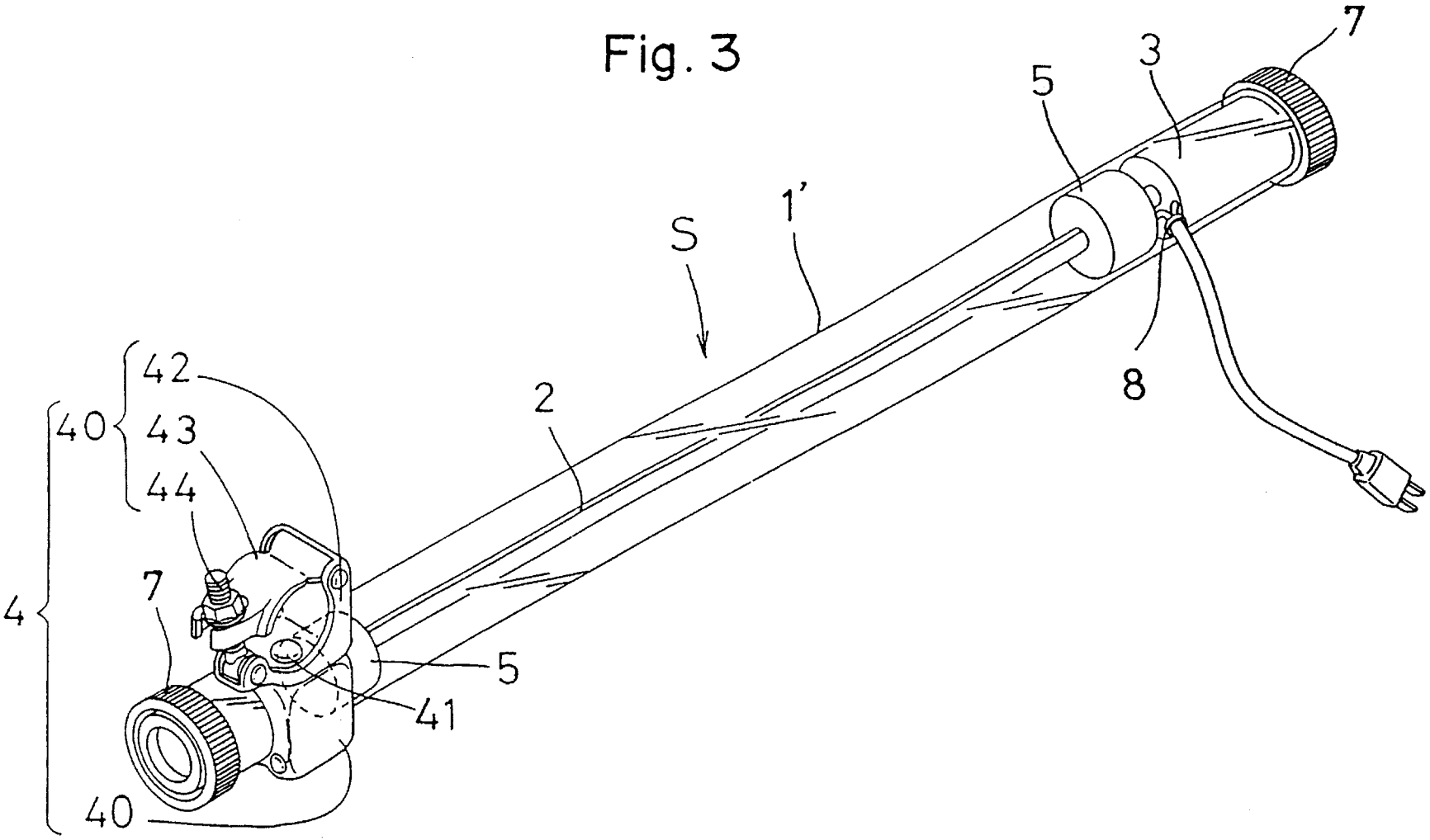
FIG. 3 is a general perspective view of a decorative tube with neon tube in a second embodiment of the present invention.
Figure 4:
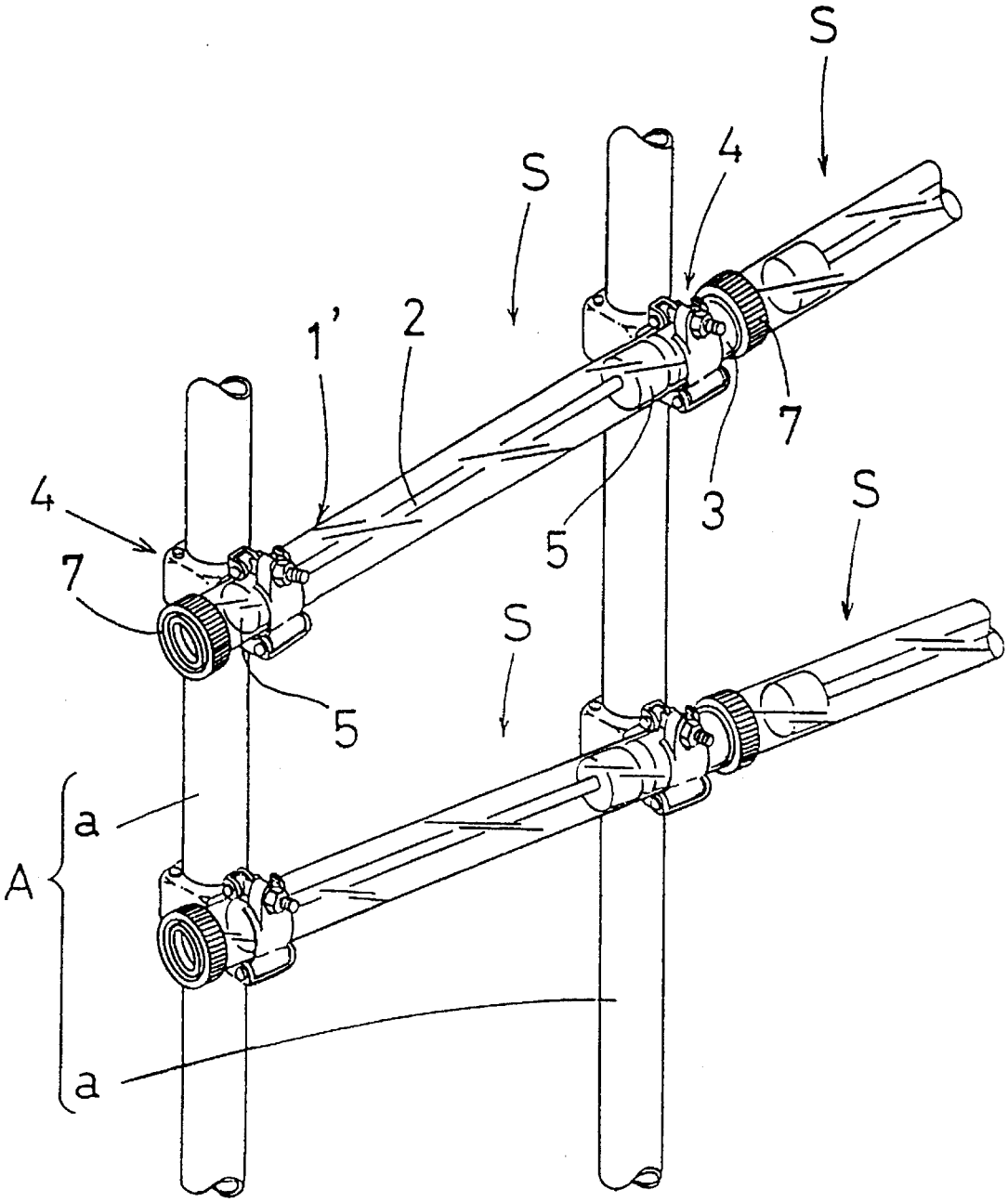
FIG. 4 is a view showing at state where plural decorative tubes of the second embodiment are fixed to the steel pipes constructing a scaffold.

The second embodiment of the present invention is also a decorative tube to be installed on a scaffold set up at a construction site (hereinafter referred to as decorative tube S) as described above. As shown in FIG. 3 and FIG. 4, the decorative tube S comprises a neon tube 2 and a transformer 3 within a transparent tubular body 1'. The transformer 3 is for properly setting the neon tube in a luminous state. Plug members 7 are provided at both the ends of the transparent tubular body 1'. A clamp member 4 for setting the decorative tube S to a scaffold is provided at an end (or both ends) of the transparent tubular body 1'.

The transparent tubular body 1' is made of transparent hard synthetic resin as shown in FIG. 3, and its size is 1.5 m in length and 48 mm in diameter.

The neon tube 2 approximately measures 1.2 m in length and 12 mm in diameter, and its both ends are stably supported by the elastic supporting members (made of urethane rubber) disposed within the transparent tubular body 1', as shown in FIG. 3.

The transformer 3 is designed to avoid dew construction inside, and, as shown in FIG. 3, formed in a columnar shape with a slightly smaller diameter than the inside diameter of the transparent tubular body 1'. Its capacity is 8 W, 0.1 A, so that the househould power source may be directly used out of a wall outlet. In this embodiment, the wiring of the connecting part to the wall outlet is penetrating into and projecting from near the position where the transformer 3 is disposed in the transparent tubular body 1', and a bush 8 made of elastic rubber is placed in the portion where the wiring is penetrating and projecting so as to keep the tubular body 1' sealed.

Figure 5:
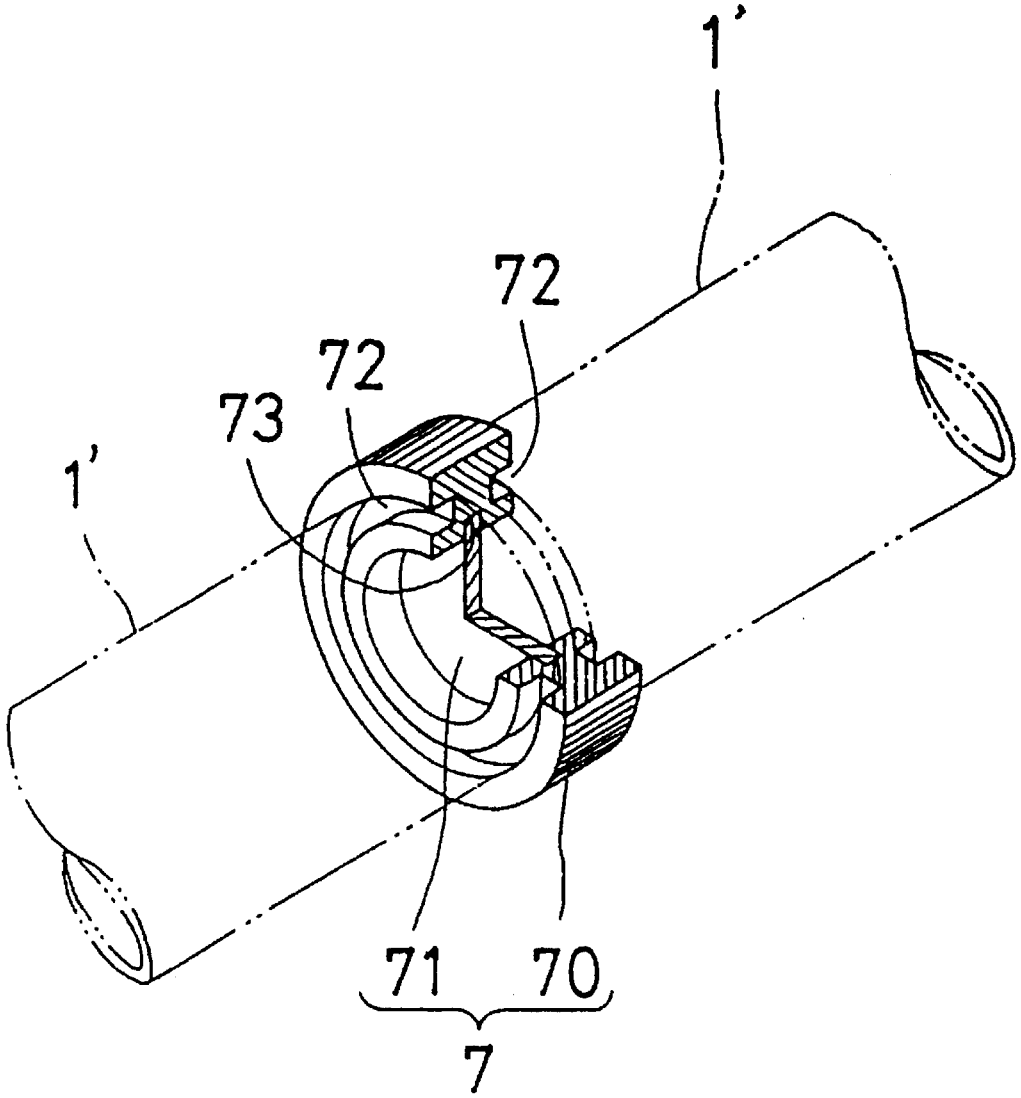
FIG. 5 is a sectional perspective view of a plug member in the decorative tube in the second embodiment.

In the second embodiment, as a connecting member, a plug member 7 is composed of a ring 70 and a disc 71 to be fitted in the hole of the ring 70 as shown in FIG. 5, both being made of elastic rubber. The ring 70 has, a shown in FIG. 5, peripheral grooves 72 formed on its both end faces, and a fine groove 73 formed in its inner circumference. The width of the peripheral groove 72 is slightly smaller than the wall thickness of the transparent tubular body 1', and the width of the fine groove 73 is slightly smaller than the wall thickness of the disc 71. Therefore, as shown in FIG. 3, when the plug members 7 are firmly fitted with the both ends of the transparent tubular body 1', the sealing of the transparent tubular body 1' is obtained. Besides, by employing the peripheral groove 72 formed on both the end faces of the plug members 7, two transparent tubular bodies 1' can be easily coupled together as shown in FIG. 5.

The clamp member 4 is composed same as in the first embodiment, and adjusting the bolt and nut 44 allows the clamp member 4 to be easily detached from the transparent tubular body 1' or the position of the tubular body 1' to be easily altered, and the tubular body 1' may be easily detached from a steel pipe (a) constituting a scaffold (A).

Figure 6:
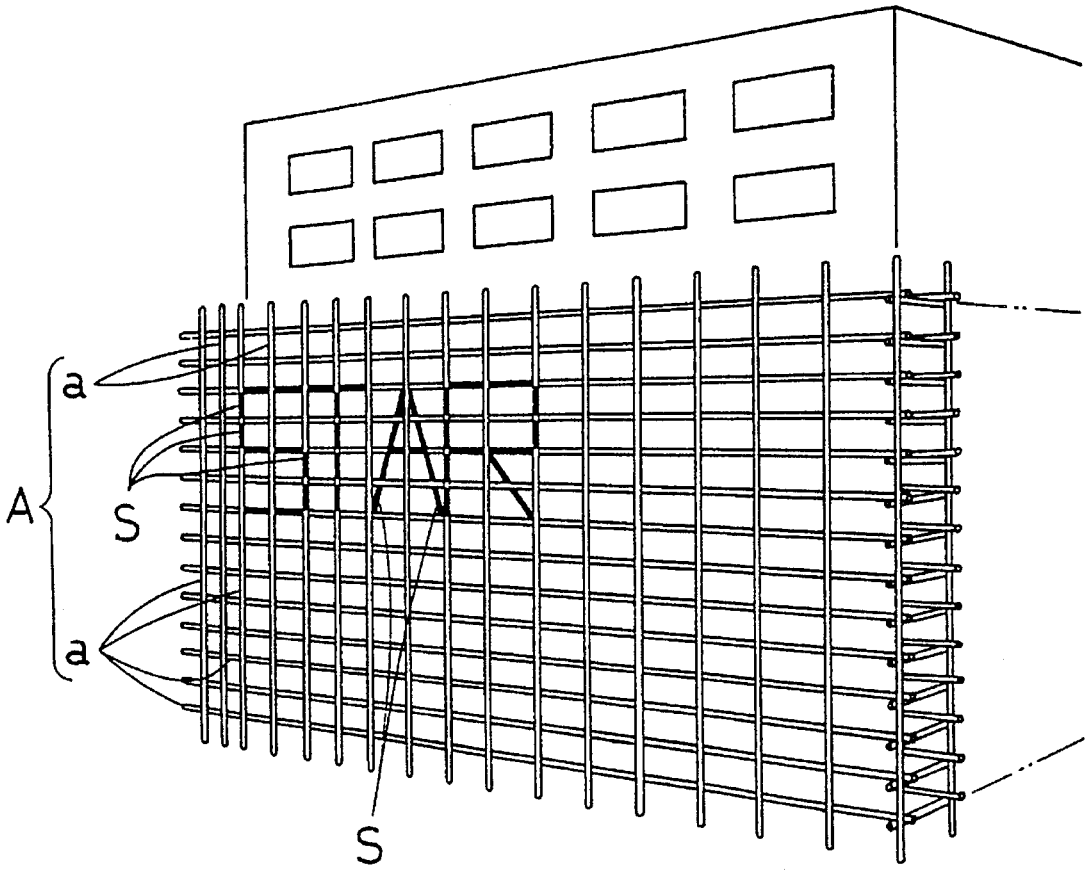
FIG. 6 is a view showing a state where characters "STAR" are drawn with plural decorative tubes on a scaffold.

Since the decorative tubes S of the embodiments of the present invention are composed as described above, the decorative tubes S may be installed parallel or vertical or with a variety of position with respect to the steel pipe (a) constituting a scaffold (A) by means of the clamp member 4, as shown in FIGS. 2 and 4. And with a large number of decorative tubes S, characters (or even pictures) can be drawn on the scaffold (A) set up around the structure, as shown in FIG. 6.

Therefore, when thus fixed multiple decorative tubes S are put into a luminous state, the dark image of construction sites may be swept away, and furthermore it may be used as a commercial aid by drawing the name of the construction company or so.

In the foregoing embodiments, the decorative tubes S are employed in the scaffold (A) set up at construction sites, but the present invention is not limited to such a use alone, and may be similarly used in frames or scaffolds set up at event halls, concert halls, discotheques or the like.

Figure 7:
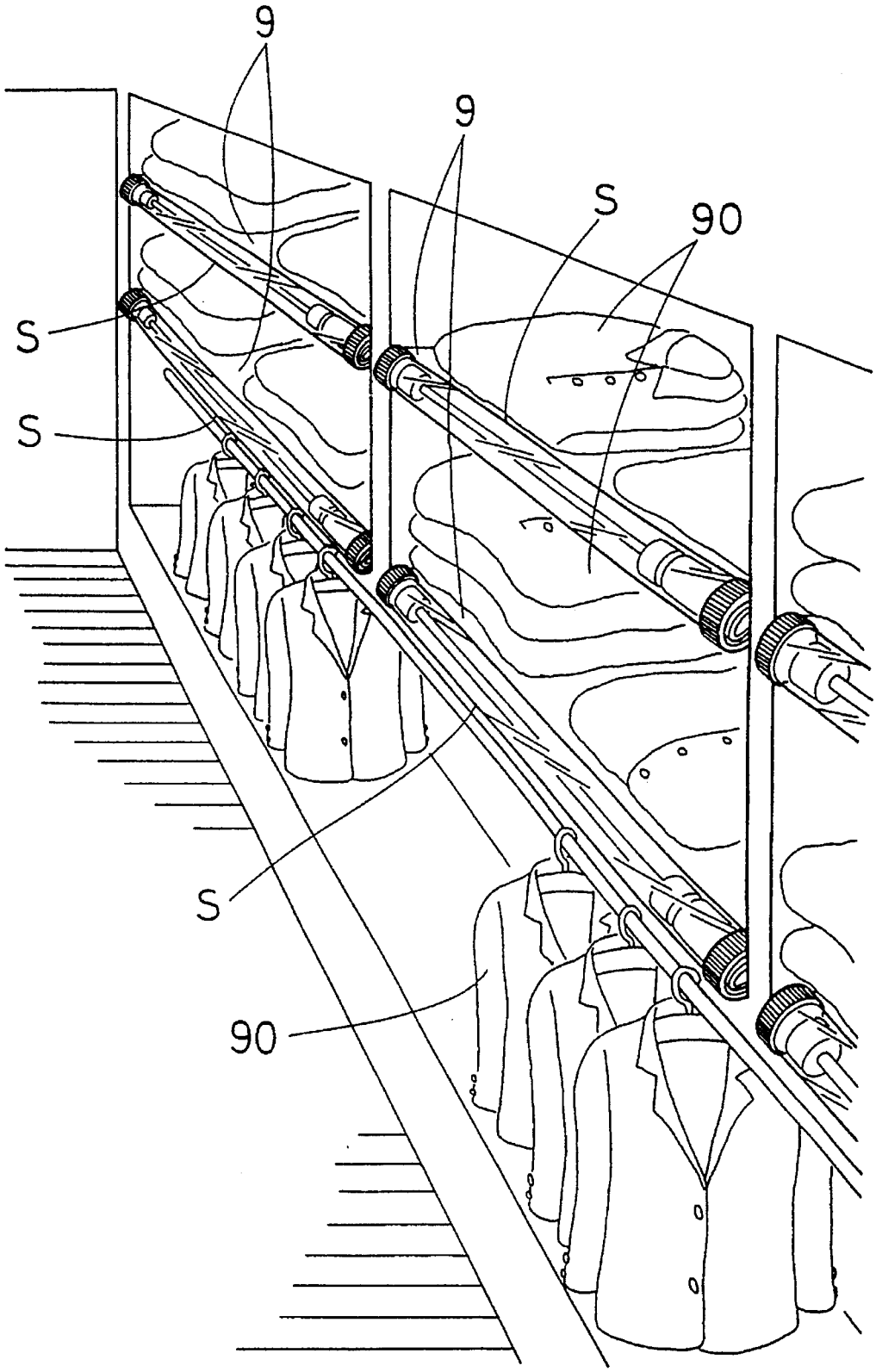
FIG. 7 is a view showing another way of using the decorative tubes of the present invention.

The decorative tubes S may be also used indoors, such as in a boutique. More particularly an installing member is attached to one end of each tubular body 1, 1', so that the tubular body 1, 1' may be projected from the wall by means of the installing member. Or, as shown in FIG. 7, the tubular bodies 1, 1' may be disposed to racks 9 for displaying the merchandise 90. (Transparent tubular bodies 1' are illustrated in FIG. 7, however, tubular bodies 1 are also used similarly.)

The present invention, being thus composed, brings about the following effects.

The appearance of installing bases (scaffolds set up at construction sites, frames or scaffolds set up at event halls, concert halls, discotheques or the like) may be improved, and when the installing base is large in area, it may be used as a canvas and characters or pictures may be drawing with a number of the decorative tubes, so that the aesthetic effect may be further enhanced.

Since the decorative tubes are easily assembled to or disassembled from installing bases and also they are easily connected with and disconnected from each other, they may be easily moved to another place after being used.

Besides, when the neon tube is supported by the elastic bushing disposed within the tubular body, the impact transmitted to the neon tube from outside through the hard tubular body becomes smaller, so that the loss or damage rate becomes lower.

I claim:

1. A portable decorative tube with neon tube comprising a hard tubular body, a neon tube and a transformer which is for properly setting the neon tube in a luminous state, the neon tube and the transformer being provided within the hard tubular body so that the decorative tube is directly connectable to an outlet, and the decorative tube further comprising an installing member for allowing the decorative tube to be removably installed on an installing base to facilitate attachment and detachment of the decorative tube with and from the installing base, wherein the installing member comprises means for allowing a position of the decorative tube with regard to the installing base to be easily altered in various directions and wherein the hard tubular body has an opening on its circumferential wall corresponding to a region where the neon tube is disposed so that the light of the neon tube can be seen from outside of said tubular body and the transformer is of a shape substantially the same as an interior of the hard tubular body whereby the transformer can be held in a stable fashion within the tubular body and can be handled free from free of breakage during transportation and installation.

2. A decorative tube with neon tube according to claim 1, further comprising a detachable connecting member for easily assembling and disassembling the decorative tube with and from another decorative tube.

3. A portable decorative tube with neon tube comprising a transparent hard tubular body, a neon tube and a transformer which is for properly setting the neon tube in a luminous state, the neon tube and the transformer being provided within the transparent hard tubular body so that the decorative tube is directly connectable to an outlet and the decorative tube further comprising an installing member for removably installing the decorative tube on an installing base to facilitate attachment and detachment of the decorative tube with and from the installing base, wherein the installing member comprises means for allowing a position of the decorative tube with respect to the installing base to be easily altered in various directions and wherein the transformer is of the shape substantially a same as an interior of the transparent hard tubular body whereby the transformer can be held in a stable fashion within the tubular body and can be handled free from fear of breakage during transportation and installation.

4. A decorative tube with neon tube comprising a hard tubular body, a neon tube and a transformer which is for properly setting the neon tube in a luminous state, the neon tube and the transformer being provided within the hard tubular body so that the decorative tube is directly connectable to an outlet, and an installing member for allowing the decorative tube to be removably installed on an installing base, for allowing a position of the decorative tube with regard to the installing base to be easily altered and for facilitating attachment and detachment of the decorative tube with and from the installing base, and wherein the hard tubular body has an opening on its circumferential wall corresponding to a region where the neon tube is disposed so that the light of the neon tube can be seen from outside of said tubular body, the transformer is of a shape substantially the same as an interior of the hard tubular body whereby the transformer can be held in a stable fashion inside the tubular body and can be handled free from fear of breakage during transportation and installation and the installing member comprises a first member that is to support the decorative tube and a second member that is to be installed on the installing base, the first member being rotatably provided on the second member and detachably mountable on the decorative tube so that the first member is movable in circumferential and axial directions of the decorative tube, thus allowing the decorative tube to be installed on the installing base in such a manner that the position of the decorative tube is altered and that the decorative tube is detachable.

5. A decorative tube with neon tube according to claim 4, wherein the installing base is made of section steel, and characters and/or pictures are drawn by means of a plurality of decorative tubes on a section steel installing base.

6. A decorative tube with neon tube according to claim 4, wherein the installing base is a wall, and characters and/or pictures are drawn by means of a plurality of decorative tubes on the wall base.

7. A decorative tube with neon tube according to claim 4, wherein the installing base is a scaffold set up at a construction site, and characters and/or pictures are drawn by means of a plurality of decorative tubes on the scaffold.

8. A decorative tube with neon according to claim 4, further comprising an elastic bushing provided within the tubular body so as to stably support the neon tube inside the tubular body and so that impact transmitted to the neon tube from outside becomes small.

9. A decorative tube with neon tube according to claim 4, wherein the installing base is another decorative tube with or without an installing member so that a plurality of decorative tubes are assembled in three dimensions.

10. A decorative tube with neon tube comprising a transparent hard tubular body, a neon tube and a transformer which is for properly setting the neon tube in a luminous state, the neon tube and the transformer being provided within the transparent hard tubular body so that the decorative tube is directly connectable to an outlet, and an installing member for removably installing the decorative tube on an installing base, for allowing a position of the decorative tube with regard to the installing base to be easily altered and for facilitating attachment and detachment of the decorative tube with and from the installing base and wherein the transformer is of a shape substantially the same as an interior of the transparent hard tubular body whereby the transformer can be held in a stable fashion inside the tubular body and can be handled free from fear of breakage during transportation and installation and the installing member comprises a first member that is to support the decorative tube and a second member that is to be installed on the installing base, the first member being rotatably provided on the second member and detachably mountable on the decorative tube so that the first member is movable in circumferential and axial directions of the decorative tube, thus allowing the decorative tube to be installed on the installing base in such a manner that the position of the decorative tube is altered and that the decorative tube is detachable.

11. A decorative tube with neon according to claim 10, further comprising an elastic bushing provided within the tubular body so as to stably support the neon tube inside the tubular body and so that impact transmitted to the neon tube from outside becomes small.

12. A decorative tube with neon tube according to claim 10, wherein the installing base is made of section steel, and characters and/or pictures are drawn by means of a plurality of decorative tubes on a section steel installing base.

13. A decorative tube with neon according to claim 10, wherein the installing base is a wall, and characters and/or pictures are drawn by means of a plurality of decorative tubes on the wall base.

14. A decorative tube with neon tube according to claim 10, wherein the installing base is a scaffold set up at a construction site, and characters and/or pictures are drawn by means of a plurality of decorative tubes on the scaffold.

15. A decorative tube with neon tube according to claim 10, further comprising a detachable connecting member for easily assembling and disassembling the decorative tube with and from another decorative tube.

16. A decorative tube with neon tube according to claim 10, wherein the installing base is another decorative tube with or without an installing member so that a plurality of decorative tubes are assembled in three dimensions.

* * * * *

UNITED STATES PATENT AND TRADEMARK OFFICE

CERTIFICATE OF CORRECTION

PATENT NO. : 5,453,917

DATED : September 26, 1995

INVENTOR(S) : Hiroaki Ogawa

It is certified that error appears in the above-indentified patent and that said Letters Patent is hereby corrected as shown below:

Column [5], line [7]: Change "body and can be handled free from free of breakage during" to --body and can be handled free from fear of breakage during--

Column [5], line [26]: Change "transformer is of the shape substantially a same as an interior" to --transformer is of a shape substantially the same as an interior--

Signed and Sealed this

Twelfth Day of March, 1996

*Attest:*

Bruce Lehman

BRUCE LEHMAN

*Attesting Officer*

*Commissioner of Patents and Trademarks*